United States Patent [19]

Dietlein et al.

[11] Patent Number: 5,007,765

[45] Date of Patent: Apr. 16, 1991

[54] SEALING METHOD FOR JOINTS

[75] Inventors: John E. Dietlein, Bay City; Russel P. Kamis, Bay County; Peggy L. Dixon, Midland, all of Mich.

[73] Assignee: Dow Corning Corporation, Midland, Mich.

[21] Appl. No.: 245,847

[22] Filed: Sep. 16, 1988

[51] Int. Cl.[5] ..... E01C 11/02

[52] U.S. Cl. ..... 404/74; 404/66

[58] Field of Search ..... 404/64, 66, 67, 68, 404/69, 74, 47, 49; 14/16.5; 52/403

[56] References Cited

U.S. PATENT DOCUMENTS

| | | | |
|---|---|---|---|
| 3,629,986 | 12/1971 | Klittich | 404/66 |
| 3,827,204 | 9/1974 | Walters | 404/66 |
| 3,866,384 | 2/1975 | Peterson, Jr. | 404/74 |
| 4,371,630 | 2/1983 | König et al. | 156/274.4 X |
| 4,387,177 | 6/1983 | Mine | 524/788 |
| 4,410,677 | 10/1983 | Lampe | 528/17 |
| 4,514,529 | 4/1985 | Beers | 523/200 |
| 4,601,604 | 7/1986 | Clark | 404/69 |
| 4,699,540 | 10/1987 | Gibbon | 404/67 |

OTHER PUBLICATIONS

"Hidden But Essential", by J. F. Gibbs, The Construction Specifier, Mar. 1980, p. 40.

*Primary Examiner*—Ramon S. Britts
*Assistant Examiner*—Gay Ann Spahn
*Attorney, Agent, or Firm*—Edward C. Elliott

[57] ABSTRACT

Joints between surfaces are sealed by a method which cleans the joint surfaces, installs a backer rod between the joint surfaces, applies a sealant in the space over the backer rod and allows the sealant to cure. The backer rod is an open cell foam having an impervious skin. Preferably, when the surfaces are horizontal, as in a highway, the sealant used is a self-leveling sealant, preferably a silicone sealant.

17 Claims, No Drawings

SEALING METHOD FOR JOINTS

BACKGROUND OF THE INVENTION

1. Field of the Invention

This invention concerns a method and material for sealing joints, especially joints between horizontal surfaces, such as in roadways.

2. Background Information

Roadway surfaces, either on a concrete or asphalt pavement structure or an asphalt overlay, are subjected to cracking due to thermal stresses. The cracks can be due to the stresses in the pavement structure itself, in the asphalt overlay itself, or due to stresses in the overlay due to movement of the underlying pavement structure. In any case, these cracks must be sealed in order to prevent the intrusion of water and solid debris, which will further damage the asphalt roadway. Many concrete roadway surfaces have an asphalt shoulder along side the outer edge. The joint between the concrete and the asphalt must be sealed in order to prevent the intrusion of water and solid debris.

The traditional method of sealing cracks or joints in concrete and asphalt highways has been to fill the cracks with hot applied bituminous based sealants. These work in non-moving cracks, but not in those that move, such as the reflection cracks over an expansion joint in a pavement structure. U.S. patent application Ser. No. 181,790, filed Apr. 15, 1988, assigned to the assignee of the instant application describes a self-leveling silicone composition, useful as a sealant in contact with asphalt, which cures upon exposure to moisture in the atmosphere. The composition consists essentially of a hydroxyl endblocked polydiorganosiloxane; non-acidic, non-reinforcing, treated filler; diacetamido functional silane as chain extender; aminoxysilicone compound as crosslinking agent; and non-reactive silicone fluid diluent. The cured composition has an elongation of at least 1200 percent, and a modulus at both 50 and 100 percent elongation of less than 25 pounds per square inch.

Joints in highways are being sealed by placing a backer rod in the joint space at some distance below the surface of the pavement, then placing a hot melt or cold applied sealant into the space above the backer rod up to the surface of the pavement. A similar process was attempted with the self-leveling silicone sealant described in the above referenced patent application. In cases where the vertical surfaces of the joint were not smooth and parallel, it was noted that when the self-leveling sealant was used to fill in the space over the backer rod, the backer rod did not seal tightly against the joint surfaces and the self-leveling sealant flowed down through the spaces between the side of the joint and the backer rod, resulting in "sink holes" in the sealant. In some cases, the sealant flowed through to the extent that there was no longer sufficient sealant left in place to properly seal the space between the joint sides, and a seal was not established which would prevent water and debris from getting into the joint.

A technical review of backer rods is given in the article, "Hidden, but essential", J. F. Gibbs, The Construction Specifier, March 1980, p 40. This article discusses backer rods of closed cell, flexible foam material and open cell, flexible foam. The closed cell foam backer rod has a skin on the outer surface. The open cell foam backer rod does not have an outer skin. The open cell foam can be produced by an apparatus disclosed in U.S. Pat. No. 3,869,831, issued Mar. 11, 1975. This apparatus is used to cut a sheet of foam into strands of uniform cross-sectional dimensions.

The need to establish a tight seal between the joint surfaces and the backer rod is recognized in the art. The Sealants and Waterproofers Institute Applicator Training Manual "Applying Sealants" points out that "When installing self leveling or pourable sealant, take special care installing backer rod. To prevent the sealant from leaking past the rod, all gaps or holes in the rod must be plugged. Think of it as if the joint would have to hold water, At breaks in the rod, butt the two pieces tightly together. Be sure that there are no gaps at the sides of the rod. If the backer rod is not packed tightly along the entire joint, it will float to the top of the sealant. CAUTION: Never use open cell rod with pourable sealants because of its tendency to absorb and hold moisture and possibly absorb the sealant."

The method of this invention allows a seal to be formed in an irregular joint where the joint surfaces are not smooth and parallel through the use of an open cell foam rod having an impervious skin.

SUMMARY OF THE INVENTION

A method of sealing joints between surfaces makes use of a backer rod comprising an open cell foam having an impervious skin.

DESCRIPTION OF THE INVENTION

This invention relates to a method of sealing joints between surfaces, said method comprising the steps of (A) cleaning the facing joint surfaces, (B) installing a backer rod between the joint surfaces so that the space between the joint surfaces is filled by the backer rod and the upper surface of the backer rod is recessed sufficiently from the panel surface to allow installation of a sealant, the backer rod being an essentially open cell foam rod having an impervious skin, (C) applying a sealant in the space over the backer rod between the joint surfaces, and (D) allowing the sealant to cure, to form a continuous seal between the joint surfaces.

The method of this invention requires a backer rod being an essentially open cell foam rod having an impervious skin. The rod preferably has a density of from 10 to 200 kilograms per cubic meter (0.6 to 12.5 pounds per cubic foot) and a compression deflection of from 0.7 to 20.7 kilopascals (0.1 to 3 pounds per square inch) at a deflection of 25 percent. Conventional backer rods are round, flexible, continuous lengths of extruded, closed-cell foam, usually of polyethylene or polypropylene. There is an impervious skin on the surface of the rod. The resiliency and rigidity of the rod is dependent upon the pressure of the gas contained within the cells. In use, the rod is compressed when placed within a joint by choosing a rod which has a diameter such that the rod is compressed up to about 25 percent on installation. If the rod is not compressed enough, the rod does not grip the sides of the joint sufficiently to hold it in place. If the rod is compressed too much, it causes some of the cells to rupture. The gas leaking out of the ruptured cells can escape and force their way into the overlying sealant, causing bubbles and voids.

Backer rod has also been produced from thermosetting open-cell foam in round and square configurations. There is no skin on the open-cell foam. The rigidity and resiliency of the foam is dependent upon the physical properties of the material used to make the foam, commonly a polyurethane. Open cell foam backer rod is compressed at least 25 percent upon installation in order to generate enough sideways force to hold it in place. It can be compressed as much as 75 percent, allowing a wider range of joints to be filled with a smaller number of sizes of rod on hand.

Both closed cell foam backer rod having an impervious surface and open cell foam not having an impervious surface have been used with the conventional sealants. Conventional sealants do not flow, but are extruded into a joint and then tooled to force the sealant against the sides of the joint. For hot melt sealants used in highways, closed cell foam having an impervious skin has been used, as the skin prevents the flowable, hot sealant from penetrating through the rod. Open cell polyurethane backer rod has also been recommended for use with hot melt adhesives. The hot adhesive quickly cools on contact with the rod and joint sides and only penetrates a short distance into any holes or gaps before cooling and becoming non-flowing.

When the new flowable silicone sealants were evaluated for use in sealing horizontal panels, such as highways, it became apparent that the backer rod had to completely seal the space between the walls of the joint, or the sealant would slowly run out of the joint past the backer rod, because the silicone sealants flow at room temperature and require a relatively long time to cure to the point where they become non-flowing. They cure upon exposure to moisture so that after they are placed into a joint, they cure primarily from the outer surface down into the joint. This allows a long period of time for the sealant to flow through any gaps which may be present. When the sides of the joint to be sealed were of a uniform width and the sides were smooth, there was no difficulty in sealing the joint with a conventional closed cell foam backer rod having an impervious skin. Use of this rod on joints in which the width of the joint varied widely and in which the surface of the joint was irregular proved to be a problem. The rod was rigid enough so that it did not readily distort to the degree required in order to force itself tightly against a joint surface with irregularities. If a projection, such as a piece of aggregate in an asphalt highway, was present on the joint wall, the skin of the backer rod prevented it from fully sealing against the surface; small gaps would be present at the side of the projection. Where the width of the joint varied widely, such as in sawn joints between a concrete roadway and an asphalt shoulder, the limited compressibility of the closed cell foam backer rod necessitated a very careful installation procedure which required frequently changing rod size being installed so that the rod was always being compressed within the required limits. This of course gave frequent joints between pieces of rod, which also were potential spots for gaps to develop and allow the sealant to flow through.

Use of an open-cell foam backer rod with a flowable sealant is not feasible because the sealant will flow through the open cells before it cures to a non-flowable state.

The inventors of the method of this invention conceived of the idea that a method could be developed in which the backer rod would be an open cell foam so that it would have a great deal of flexibility and compressibility and also have a relatively impervious skin so that the sealant would not flow through the open cells. An open cell polyethylene foam having a skin on the surface was procured and the method of this invention was reduced to practice, as discussed in the example below.

The required open cell foam with an impervious skin can be manufactured by the forming of rods in molds using a foamable composition which gives an open cell foam. The molds can be long troughs of the desired dimensions into which are poured foamable mixtures such as those disclosed in U.S. Pat. Nos. 4,572,917, issued Feb. 25, 1986; 4,590,220, issued May 20, 1986; 4,593,049, issued Jun. 3, 1986, and 4,631,296, issued Dec. 23, 1986; each patent being incorporated by reference to show a composition and its method of manufacture, each composition giving an open cell foam upon curing. The surfaces of the foam which are against the mold will be an impervious skin, as will the upper surface of the foam which cures in contact with the atmosphere.

The backer rod used in the method of this invention is an open cell foam with an impervious skin because this combination of characteristics tends to give the foam the properties required in order for the backer rod to perform in an optimum manner. The open cell foam is very resilient and can be deformed to a great degree. It also tends to form itself around and tightly against any deformities or projections on the joint surface, thus sealing tightly against the joint surface. When a flowable sealant is used in this method, it is important that the backer rod have this ability to form around any surface roughness and give a good seal. Preferably, the backer rod has a density of from 10 to 200 kilograms per cubic meter (0 6 to 12.5 pounds per cubic foot) and a compression deflection of from 0.7 to 20.7 kilopascals ( 0.1 to 3 pounds per square inch) at a deflection of 25 percent. The density is determined by measuring the weight of a sample and determining the diameter and length and calculating the volume, then dividing the weight by the volume. The compression deflection is determined in accordance with ASTM D 1621.

The first step in the method of this invention is cleaning the facing joint surfaces. The joint can be created during the laying of the panels, such as laying bricks or patio blocks or other such prefabricated panels. In the case of highways of concrete or asphalt, the panels are horizontal panels commonly created by sawing joints through a length of continuously applied paving material as soon as the material becomes rigid enough to be worked on. In the case of repair work on a highway, an old failed joint can be repaired by sawing a wider joint which removes the old, failed joint. In an old, but previously unsealed joint, the joint may be widened by sawing, or left to its original dimensions. In either case, the joint surfaces are cleaned just before installation of the backer rod by sandblasting, air blasting, water washing, or a combination of methods. Any method can be used as long as the resulting surface is clean and dry, without any dust or dirt present to prevent the sealant from forming a satisfactory bond. If the sealant being used is a moisture curing silicone sealant, the joint face must also be dry.

The second step is the installation of the backer rod between the joint surfaces. The backer rod is an essentially open cell foam having an impervious skin. By impervious skin is meant the ability of the skin to prevent the sealant being used from penetrating into the open cells of the foam. The rod diameter is chosen so that the rod is compressed during installation enough to hold it in place, a minimum of 10 percent compression is typical. When the sealant used in this method is not tooled during installation, the rod does not have to be as firmly held as is necessary in the case where the sealant is tooled to force the sealant into intimate contact with the joint's surfaces. The open cell foam rod with an impervious skin that is used in this method can be compressed as much as 75 percent without any problem. If the joint surfaces are rough and/or the width of the joint is variable, the rod diameter should be chosen so that the rod properly forces itself onto the uneven surfaces and completely seals the joint and does not allow the sealant to flow out of the joint.

The backer rod is installed so that the upper surface of the backer rod is recessed below the panel surface. The preferred depth of the recess is such that the sealant thickness, when in place, is approximately ½ of the width of the joint at that point. The upper surface of the sealant in the joint should be about 6 millimeters ( ¼ inch) below the surface of the panels. This protects the sealant surface from mechanical damage caused by people or vehicles moving over the panels, as when the panels are sections of a walkway or roadway. A preferred method of installing the backer rod is through the use of a roller which fits into the joint and can force the rod into the joint the required distance. The roller has outer edges that ride on the surface of the horizontal panels. The diameter of the inner portion of the roller is adjustable so that the roller penetrates into the joint the desired distance.

After the backer rod is in place, the sealant is placed into the joint over the backer rod. The preferred method of applying the sealant is by means of pressure pumps and hoses to pump the flowable sealant from the storage container, through the hose, and through an applicator into the joint. The applicator is a device which rides on the surface of the horizontal panels and injects the flowable sealant into the joint space over the backer rod. The applicator is moved along the joint at a rate such that the sealant is injected into the joint space to the required depth, that is about ½ of the width of the joint. If the backer rod has been properly applied, the upper surface of the sealant is about 6 millimeters below the horizontal panel surface.

The sealant used in this method is self-leveling, that is, it is flowable under the force of gravity. As soon as it is injected into the joint space it flows down onto the upper surface of the backer rod and against the surfaces of the joint. This flowability causes the sealant to form an intimate contact with the joint surfaces, allowing a maximum bond to form between the joint surfaces and the sealant. A preferred sealant for use in this method is a flowable silicone sealant such as is described in U.S. patent application Ser. No. 181,790, filed Apr. 15, 1988, assigned to the assignee of the instant invention. This application is hereby incorporated by reference to show a flowable silicone sealant and its method of manufacture.

After the sealant is applied, it is allowed to flow out to form a tight seal and to cure into an elastomer bonded tightly to the opposing surfaces of the joint. The sealant is chosen so that it forms a bond to the joint surfaces. The sealant has a low modulus so that when the joint moves the stress on the bond is low. The impervious skin on the open cell backer rod prevents the sealant from penetrating into the open cell foam. The skin on the foam gives a smooth lower surface to the sealant which aids in allowing the sealant to expand and contract without failure when the joint faces move due to expansion and contraction of the panel material caused by the effects of settling and temperature changes.

The following examples are included for illustrative purposes only and should not be construed as limiting the invention which is properly set forth in the appended claims.

EXAMPLE 1

This is an example illustrating the prior art.

Highway joints of concrete and asphalt were prepared and sealed using the conventional polyethylene closed cell backer rod and new self-leveling silicone sealants.

Old polysulfide sealant which had failed was removed from the highway joints by sawing a ½ inch wide section out of the transverse joints to remove the old sealant and form a new. clean surface between the sections of concrete highway. The joint faces were then cleaned by sandblasting and air blasting. The longitudinal joints were sawed to a ⅜ inch width and cleaned as above. The joint between the concrete pavement and the asphalt shoulder was also sawed to a ⅜ inch width, but sawing was more difficult and the joint width was very irregular.

A backer rod was installed in the joints. A ⅝ inch diameter conventional closed cell backer rod was installed in the ½ inch wide transverse joints to a depth so that the upper surface of the rod was about 11/16 inch below the pavement surface. A ⅝ inch diameter rod was also installed in the ⅜ inch wide longitudinal and shoulder joints.

The prepared joints were then sealed by pumping sealant through hoses and an application head to fill the space above the backer rod with ¼ inch of the sealant. The sealants used were an experimental self-leveling silicone sealant (A) having a durometer of about 40 on the Shore 00 scale, a modulus of about 15 pound per square inch at 100 percent elongation, and an elongation at break of greater than 1400 percent and an experimental self-leveling silicone sealant (B) having a durometer of about 63 on the Shore 00 scale, a modulus of about 30 pounds per square inch at 100 percent elongation, and an elongation at break of greater than 1400 percent. The sealants were alloWed to floW into place, there was no tooling done after installation of the sealant into the joint space as is done with the normally used non-leveling sealants. The sealants not only flowed to give a good seal against the joint surfaces, they flowed through any gaps between the backer rod and the joint surfaces, particularly in the case of the shoulder joint having an irregular width. The portions of the joint in which the backer rod failed to completely seal the joint were not satisfactory in that the sealant did not form a good seal between the opposing joint faces because it ran out of the joint past the backer rod, leaving a "sink hole" in the joint.

EXAMPLE 2

Transverse joints in a concrete bridge in Texas were sealed using the method of this invention.

The joints were cleaned by sandblasting. The joints varied in width from ¾ inch to 1¼ inch along their length. After cleaning, each joint was sealed by installation of a 1¼ inch diameter backer rod having open cells and a skin and having a density of about 13 kilograms per cubic meter (0.8 pounds per cubic foot), and a compression deflection of about 6.9 kilopascals (1 pound per square inch), and the ability to be compressed to about 70 percent of its original diameter. The rod was obtained from Applied Extrusion Technologies, Middletown, Del. The backer rod was installed by use of a wheel which forced the rod into the joint space so that the surface of the rod was about ½ inch below the concrete surface. The rod completely filled the width of the joint space, sealing against the opposing faces, in spite of the fact that the joint space was variable. After placement of the backer rod, the prepared joints were then sealed by pumping sealant through hoses and an application head to fill the space above the backer rod with approximately ¼ to ½ inch of the sealant. The sealant used was self-leveling silicone sealant (A), described in Example 1. The sealant was allowed to flow into place, there was no tooling done after installation of the sealant into the joint space as is done with the normally used non-leveling sealants. The sealant flowed out to completely seal the joint space, flowing into the surface of the joint and forming a tight bond. The sealant did not flow beyond the backer rod because the backer rod was sufficiently deformable to form a tight seal along the irregular faces of the joint surfaces. The sealant did not bond to the backer rod because the skin over the surface of the backer rod prevented the sealant from flowing into the pores of the backer rod and the sealant did not adhere to the skin on the backer rod surface. A complete seal to both sides of the joint was formed without tooling the sealant after application to the joint, and without "sink holes" forming from the sealant flowing through openings between the backer rod and the sides of the joint.

EXAMPLE 3

A backer rod was prepared from a silicone foaming system.

A base material was prepared by mixing 29.6 parts of a dimethylvinylsiloxy endblocked polydimethylsiloxane having a viscosity of about 0.4 Pa.s at 25° C., 38.6 parts of a hydroxyl endblocked polydimethylsiloxane having a viscosity of about 13.5 Pa.s and a hydroxyl content of about 0 08 percent, 14.8 parts of a ground quartz having an average particle size of about 5 micrometers, 5 parts of pigment, 0.8 parts of trimethylsiloxy endblocked polymethylhydrogensiloxane having a viscosity of about 0.13 Pa.s at 25° C. and a silicon-bonded hydrogen atom content of about 1.6 percent by weight, 2.6 parts of normal propanol, and 8.82 parts of a fluorine-containing polyorganosiloxane foam stabilizer designated as reaction product (A) in Example 1 of U.S. Pat. No. 4,554,296. issued Nov. 19, 1985.

A curing agent was prepared by mixing 50.6 parts of the above hydroxyl endblocked polydimethylsiloxane, 13.9 parts of the above ground quartz, 9.7 parts of a hydroxyl endblocked polydimethylsiloxane having a viscosity of about 0.04 Pa.s at 25° C. and a hydroxyl content of about 3.25 weight percent, 24 parts of trimethylsiloxy endblocked polymethylhydrogensiloxane having a viscosity of about 0.13 Pa.s at 25° C. and a silicon-bonded hydrogen atom content of about 1.6 percent by weight, and 2.2 parts of trimethylsiloxy endblocked polydiorganosiloxane having an average of five methylhydrogensiloxane units and three dimethylsiloxane units per molecule with a silicon-bonded hydrogen atom content in the range of about 0.7 to 0.8 weight percent.

An open cell foam rod was produced by mixing the above base with the above curing agent at a 1 to 1 ratio by volume and immediately pouring the mixture into a ⅜ inch channel where the mixture foamed and cured. After the foam had cured the molded rod was removed from the channel. The foam had a very good skin on all sides. The foam had about 88 percent open cells. The rod had a density of from 130 to 200 kilograms per cubic meter (8.1 to 12.2 pounds per cubic foot) along its length. The rod had a compression deflection at 25 percent deflection of from 0.7 to 1.0 kilopascal.

That which is claimed is:

1. A method of sealing joints between surfaces, said method comprising the steps of (A) cleaning the facing joint surfaces, (B) installing a backer rod between the joint surfaces so that the space between the joint surfaces is filled by the backer rod and the upper surface of the backer rod is recessed sufficiently from the panel surface to allow installation of a sealant, the backer rod being an essentially open cell foam rod having an impervious skin, (C) applying a sealant in the space over the backer rod between the joint surfaces, and (D) allowing the sealant to cure, to form a continuous seal between the joint surfaces.

2. The method of claim 1 in which the joints being sealed are between horizontal panels having facing vertical surfaces which form the joint to be sealed, the backer rod being installed at a depth in the joint equal to approximately ½ the width of the joint plus 6 millimeters, and the sealant being a self-leveling sealant.

3. The method of claim 2 in which the backer rod has a density of from 10 to 200 kilograms per cubic meter and a compression deflection of from 0.7 to 20.7 kilopascals at a deflection of 25 percent.

4. The method of claim 3 in which the self-leveling sealant is a silicone sealant.

5. The method of claim 4 in which the horizontal panels are a part of a concrete roadway.

6. The method of claim 4 in which the horizontal panels are a part of an asphalt roadway.

7. The method of claim 4 in which the horizontal panels are a part of a concrete roadway with asphalt shoulders.

8. A backer rod for use in sealing joints comprising an open cell foam having an impervious skin.

9. The backer rod of claim 8 in which the rod has a density of from 10 to 200 kilograms per cubic meter and a compression deflection of from 0.7 to 20.7 kilopascals at a deflection of 25 percent.

10. In a method of sealing joints between surfaces, said method including the steps of (A) cleaning the joint surfaces, (B) installing a backer rod between the joint surfaces, (C) applying a sealant in the space over the backer rod, and (D) allowing the sealant to cure to form a continuous seal between the joint surfaces, the improvement which consists of using a backer rod which is an open cell foam having an impervious skin.

11. The method of claim 10 in which the joints being sealed are between horizontal panels having facing vertical surfaces which form the joint to be sealed the backer rod being installed at a depth in the joint equal to approximately ½ the width of the joint plus 6 millimeters, and the sealant being a self-leveling sealant.

12. The method of claim 10 in which the backer rod has a density of from 10 to 200 kilograms per cubic meter and a compression deflection of from 0.7 to 20.7 kilopascals at a deflection of 25 percent.

13. The method of claim 12 in which the self-leveling sealant is a silicone sealant.

14. The method of claim 13 in which the horizontal panels are a part of a concrete roadway.

15. The method of claim 13 in which the horizontal panels are a part of an asphalt roadway.

16. The method of claim 13 in which the horizontal panels are a part of a concrete roadway with asphalt shoulders.

17. A method of sealing joints between horizontal panels having facing vertical irregular surfaces, said method consisting essentially of the steps of (A) cleaning the facing joint surfaces, (B) installing a backer rod between the joint surfaces so that the space between the joint surfaces is filled by the backer rod and the upper surface of the backer rod is recessed sufficiently from the panel surface to allow installation of a sealant, the backer rod being an essentially open cell foam rod having an impervious skin and having a density of from 10 to 200 kilograms per cubic meter and a compression deflection of from 0.7 to 20.7 kilopascals at a deflection of 25 percent.

(C) applying a self-leveling silicone sealant in the space over the backer rod between the joint surfaces, and (D) allowing the sealant to cure by exposure to atmospheric moisture, to form a continuous seal between the joint surfaces.

* * * * *